US006698972B1

(12) United States Patent
Attar

(10) Patent No.: US 6,698,972 B1
(45) Date of Patent: Mar. 2, 2004

(54) PROCESS OF MANUFACTURING ONE PIECE REFLECTIVE PAVEMENT MARKER AND DELINEATOR

(76) Inventor: Adil Attar, P.O. Box 3883, Ontario, CA (US) 91761

( * ) Notice: Subject to any disclaimer, the term of this patent is extended or adjusted under 35 U.S.C. 154(b) by 504 days.

(21) Appl. No.: 09/634,430

(22) Filed: Aug. 8, 2000

Related U.S. Application Data

(63) Continuation-in-part of application No. 09/385,091, filed on Aug. 30, 1999, now Pat. No. 6,334,734.

(51) Int. Cl.[7] ..... E01F 11/00
(52) U.S. Cl. ..... 404/16
(58) Field of Search ..... 404/12, 14, 16

(56) References Cited

U.S. PATENT DOCUMENTS 4,136,991 A * 1/1979 Clark et al. ..... 404/73
4,726,706 A * 2/1988 Attar ..... 404/14
5,267,809 A * 12/1993 Allan ..... 404/14
5,425,596 A * 6/1995 Steere et al. ..... 404/14
5,449,244 A * 9/1995 Sandino ..... 404/14
5,667,335 A * 9/1997 Khieu et al. ..... 404/14
5,927,897 A * 7/1999 Attar ..... 404/12
5,975,706 A * 11/1999 Nakayama ..... 359/530
6,056,426 A * 5/2000 Jenkins ..... 362/558
6,126,360 A * 10/2000 May et al. ..... 404/14

FOREIGN PATENT DOCUMENTS

GB WO 91/11787 * 8/1991 ..... G08B/5/00

* cited by examiner

*Primary Examiner*—Thomas B. Will
*Assistant Examiner*—Raymond Addie

(57) ABSTRACT

A Method of manufacturing a hollow, one piece, reflective pavement marker, including at least one retro-reflective face. The method includes molding a plurality of cube-corner reflective elements within a plurality of cells, defined by plural load carrying and partitioning walls. The pavement marker includes a profiled lower surface to improve agglutination to a roadway. The pavement marker can be made from high impact and abrasion resistant thermoplastics.

1 Claim, 6 Drawing Sheets

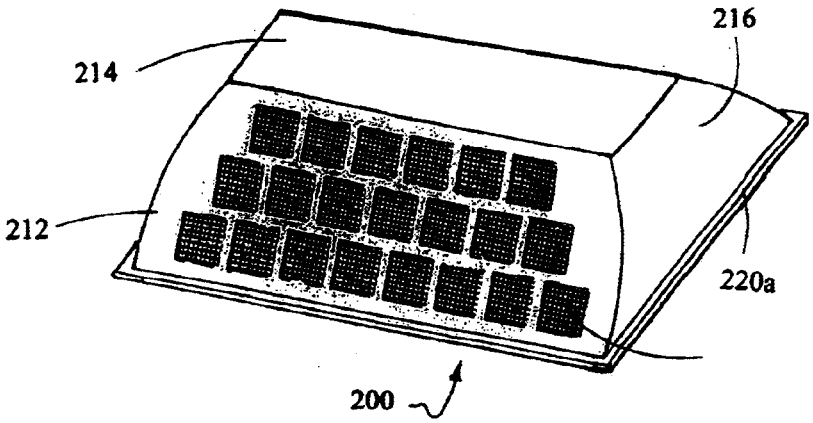
FIG.1
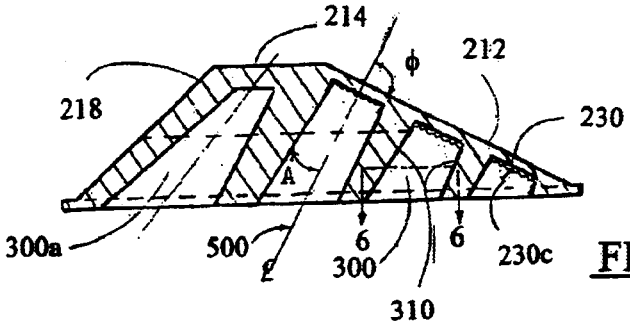
FIG.4
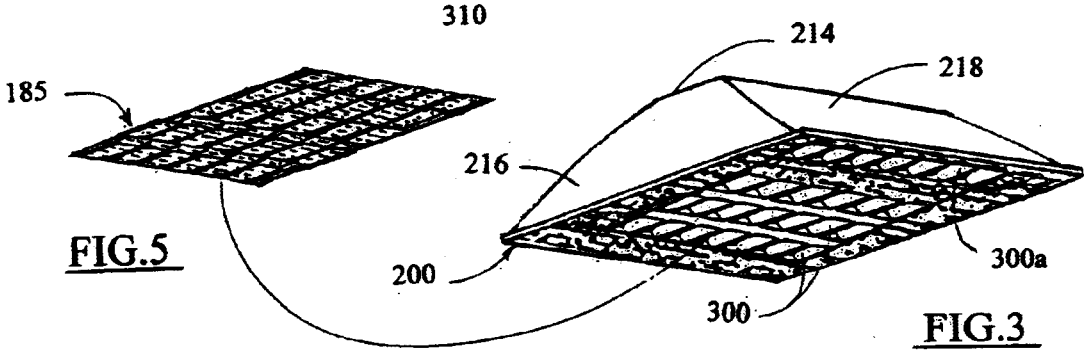
FIG.5
FIG.3
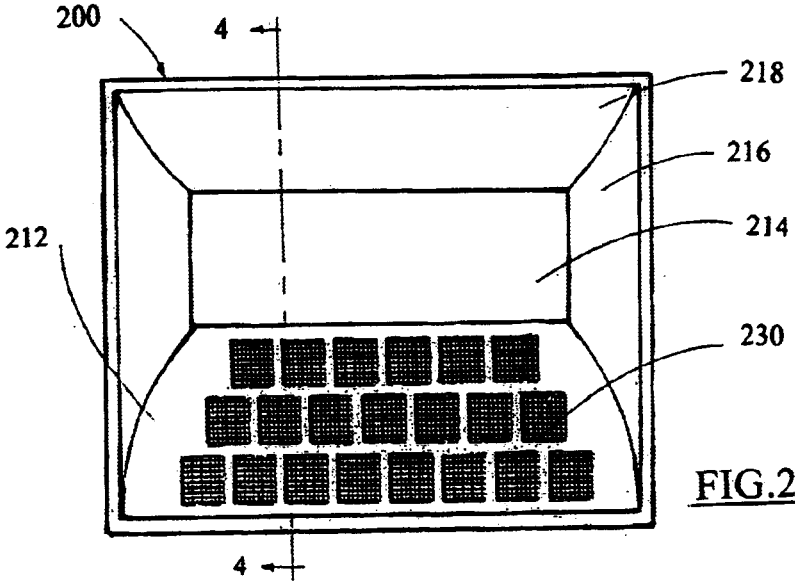
FIG.2
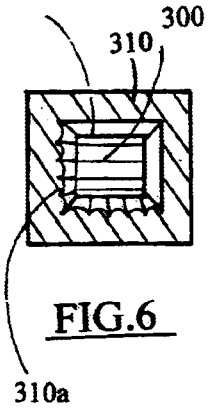
FIG.6

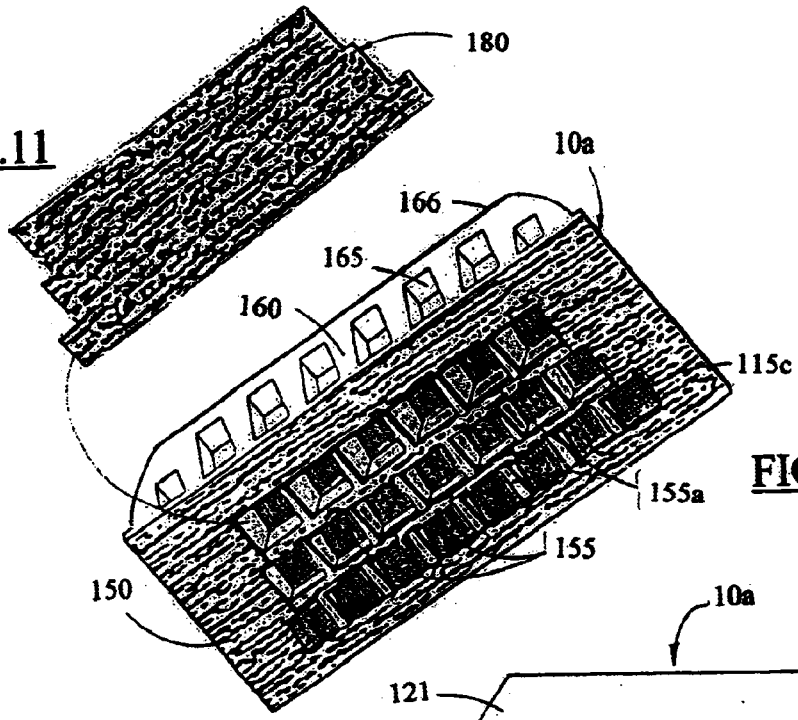
FIG.11
FIG.10
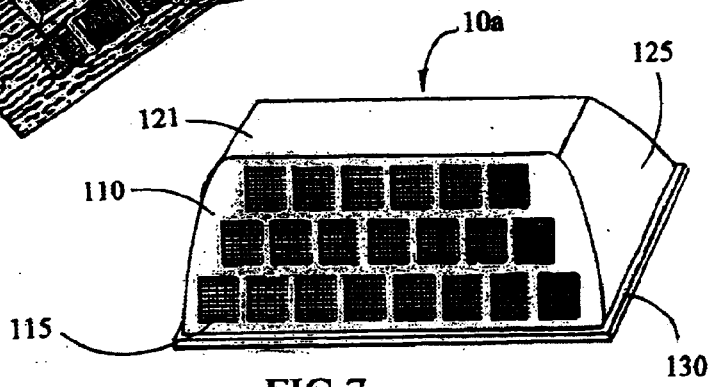
FIG.7
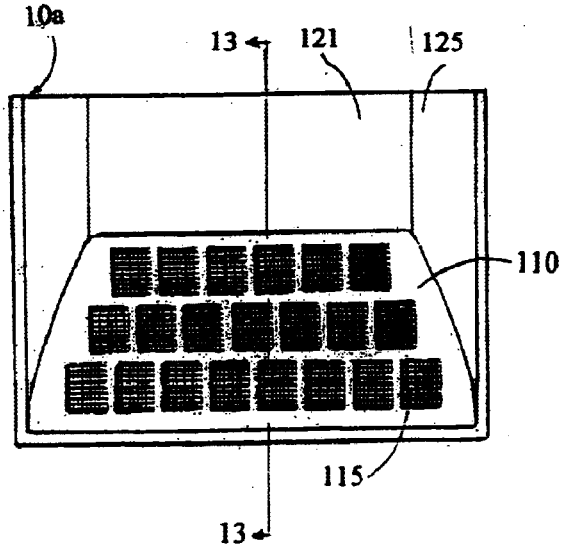
FIG.8
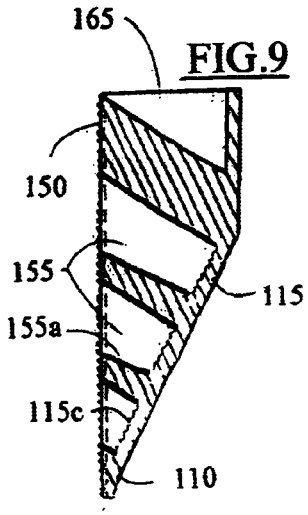
FIG.9

PROCESS OF MANUFACTURING ONE PIECE REFLECTIVE PAVEMENT MARKER AND DELINEATOR

This a CIP of application Ser. No. 09/385,091, filed Aug. 30, 1999, now U.S. Pat. No. 6,334,734.

BACKGROUND OF INVENTION

1. Field of Invention

This invention relates to the process of forming roadway markers that are used for traffic lane delineation, in particular, to markers with enhanced reflectivity and abrasion resistant.

2. Related Art

Roadway markers are adhered to pavements along centerlines, edge lines, lane dividers or guardrail delineators. Other roadway markers are used as temporary lane dividers in temporary constructions, detours or prior to permanent marking of newly paved roadways. Since 1965, the most commonly used retroreflective roadway markers are based on Heenan U.S. Pat. No. 3,332,327, Balint U.S. Pat. No. 3,409,344, or Edouart U.S. Pat. No. 4,991,994. Typically, this type of markers are produced in a process consisting of four or five steps: Firstly, injection molding of a thermoplastic shell, either integrally molded with the reflective face, or the reflective faces welded on a corresponding open recesses within the shell. The reflective face, having about 350 or more cube corner reflective elements on each reflective face of the shell. Secondly, either the reflective faces within a shell or the entire inside surface of the shell coated with a reflective metallic sealer by a process known as vacuum metalizing. This metallic sealer needed to seal the cube corner reflective elements so they retain part of their retroreflectivness prior to the next step of filling the shell with a thermosetting resinous material, such as epoxy or polyurethane.

This resinous filler material encapsulate the metalized cube corner reflective elements and give the marker the structural body. Finally, a layer of relatively course sand or glass beads dispersed over the top surface of the filler material prior to solidification of the filler material. This top surface will be the marker's base. Part of the sand particles will remain partially protruding above this planar surface of the marker base, thereby increase the adhesive welding parameter of the base surface. The protruded sand will improve adhesion to substrate, regardless of the type of adhesive used. This type of markers worked well for six or seven months, however, due to poor abrasion and impact resistant of the thermoplastic shell, over 60% of the reflectivity lost thereafter. Also, incompatibility of the shell material to the resinous filler material causes pealing of the reflective face or the shell, thereby losing retroreflectivity. Several attempt were made to improve abrasion resistant of the reflective face. One was the use of thin layer of untempered glass as disclosed in U.S. Pat. No. 4,340,319, another attempt was the use of polymeric coating of the reflective face, as disclosed in U.S. Pat. No. 4,753,548 to (Forrer). These abrasion resistant coating proving to be expensive and tend to reduce retro reflectivity. Other major development in the pavement marker art has been made, this was achieved by eliminate the use of the metalized sealer for the cube corner reflective elements. By dividing the inside surface of the reflective face into reflective cells, each cell will have several cube corner reflective elements, the cells isolated from each other by partition and load carrying walls. The reflective faces welded to corresponding recesses within a hollowed body.

This method is disclosed in U.S. Pat. Nos. 4,227,772 (Heenan); 4,232,979; and 4,340,319 (Johnson et al); U.S. Pat. No. 4,498,733 (Flanagan). These markers proved to be superior in reflectivity, however, lack of structural strength and poor adhesion cause short life cycle for this type of markers.

This applicant successfully developed two multi-cell reflective roadway markers. One roadway marker utilizes raised rhombic shaped abrasion reducing and load transferring raised ridges, said ridges intercede abrasion elements and impact load. The shell filled with epoxy, hence, the marker body having a base with large wetting parameter for shear and flexural strength , as disclosed in U.S. Pat. No. 4,726,706. The second roadway marker of this applicant, U.S. Pat. No. 5,927,897 developed a mean to increase the abrasion resistant of the reflective face by coating the reflective face with diamond-like film and by having holding pins extending from the partition walls into the body, the holding pins sealed by the filler material; this works very effectively. The entire above reflective pavement markers are incorporated herein by reference in their entireties. The present goal of Applicant is to have a durable roadway marker with high reflectance, abrasion resistant, low cost, marker base area with good welding parameter and one-step process to manufacture said reflective pavement marker.

SUMMARY OF THE INVENTION

This invention provide a novel process of forming one piece raised roadway marker or delineator that comprises a monolithically injected Body integrally with one or two reflective faces and a base having large adhesive welding parameter for better adhesion to the pavement and higher resistance to flexural stresses.

The primary objective of this invention is to provide one steps process for making reflective pavement markers or delineator while retaining maximum reflectivity and structural strength. Another objective of this invention is to provide a raised roadway marker made of high impact and abrasion resistant material and high quality reflective index.

The present invention further provide a method of making one piece raised roadway marker of any desirable shape and configuration, such as, a marker with truncated body or one piece delineator with two vertically positioned reflective faces, with means to include cube corner reflective elements on the interior of said faces, and having grooved planar base surface.

In accordance with still further aspect of this invention, the marker can be made for one or two way traffic usage; having integrally built-in reflective faces provides durability and cost effectiveness. Also two multi colored parts can be welded together to form multi colored reflective pavement marker.

BRIEF DESCRIPTION OF THE DRAWINGS

The advantages and unique features of this invention will be better understood by reference to the drawings. These drawings are schematics, no scale used. In the drawings:

FIG. 1 is an isometric view of one of the preferred one-piece pavement marker of the invention;

FIG. 2 is a plan view of the pavement marker illustrated in FIG. 1;

FIG. 3 is another isometric view of pavement marker in FIG. 1 showing the base portion with grooved surface and the end opening for the hollow recesses;

FIG. 4 is a cross section view taken along the line 4—4 in FIG. 2;

FIG. 5 is an isometric view of a thin plate that can be used to seal the ends of hollow recesses;

FIG. 6 is a section view taken along the line 6—6 in FIG. 4 showing partly grooved surfaces of a hollow recess;

FIG. 7 is an isometric view of yet another embodiment of one-piece marker of the invention;

FIG. 8 is a plan view of the marker in FIG. 7;

FIG. 9 is a cross section view taken along the line 13—13 in FIG. 8;

FIG. 10 is isometric view of the marker in FIG. 7 showing the base surface and the back portion;

FIG. 11 is an isometric view of a sealing plate for the base of marker in FIG. 7;

Figure 12:
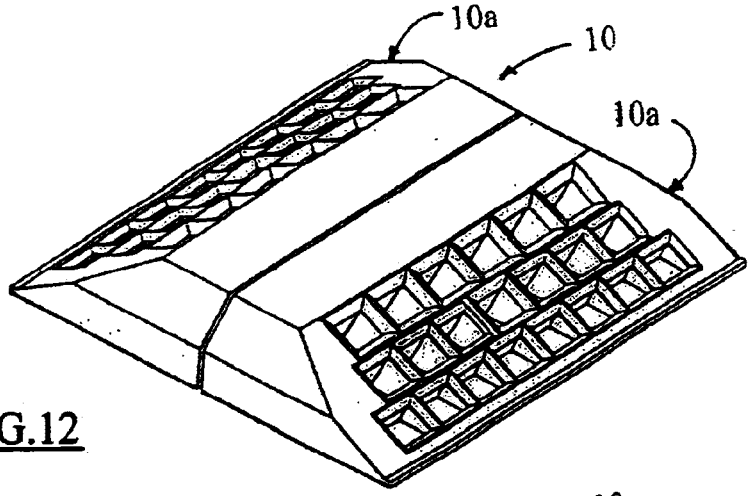
FIG. 12 is an isometric view of two welded markers of FIG. 7.
Figure 13:
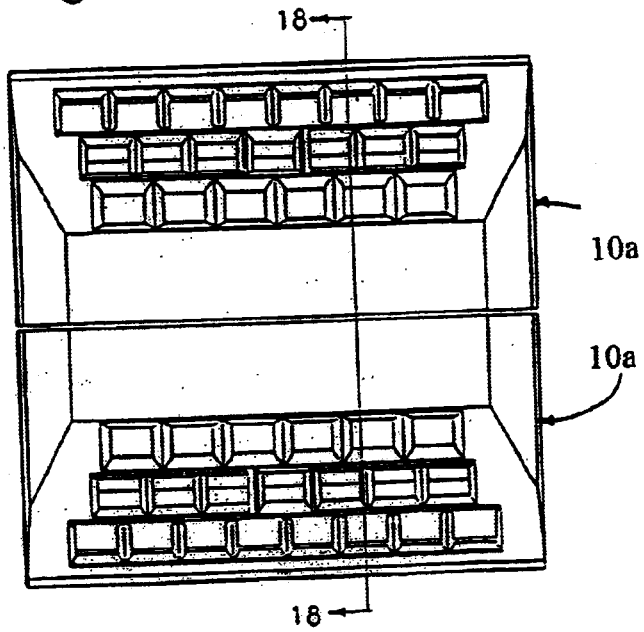
FIG. 13 is a plan view of the marker in FIG. 12.
Figure 14:
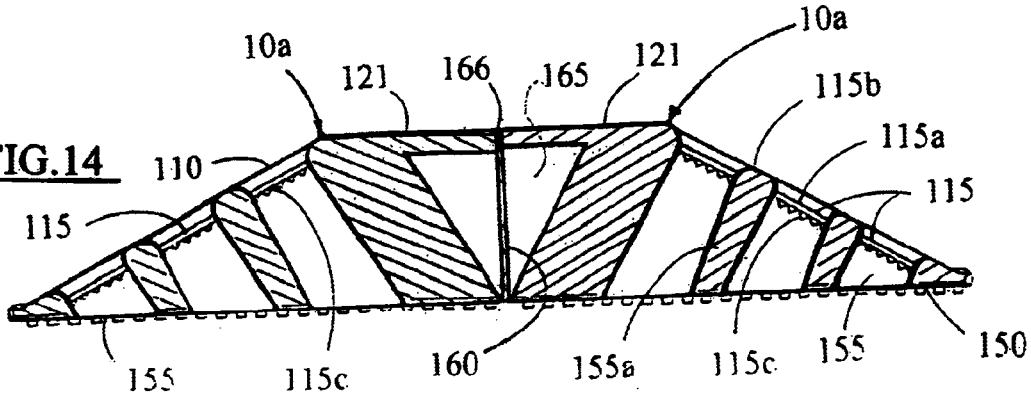
FIG. 14 is a cross section view taken along the line 18—18 in FIG. 12.

This is a continuation in part of Ser. No. 09/385,091, filed Aug. 30, 1999

DESCRIPTION OF THE PREFERRED EMBODIMENTS

Enhanced reflectivity, durability, cost effectiveness and simplified production method can be achieved by eliminating major steps or processes used in previous arts for manufacturing reflective pavement markers. This invention is satisfying the above conditions.

This invention eliminate the process of metalizing the reflective face, eliminate the step of welding a backing sheet or a lens mounting sheet to the reflective face; eliminate filling the marker body (shell) with inert filled or fiber reinforced resinous material or welding a unitarily molded block with flattened base to a shell; eliminate a lens mounting structure and a base layer added to marker body. This invention simply developed a process of making a monolithic reflective pavement marker in one-step process, this process comprises a mold that provide the means to form: the structural body, the cube corner reflective elements as well as a hollow cavity means that allow integrally forming of said cube corner reflective elements.

Referring to FIGS. 1 through 6 represent one of the preferred embodiment of a durable one-piece reflective pavement marker designated by the number 200, that is formed utilizing the process of the present invention, which comprises means to integrally cast marker 200 including at least one reflective face 212.

Marker 200 has a top portion 214, two arcuate sides 216, two inclined planar faces 218 and 212 that are facing opposing traffics, with at least one face (212) is provided with means to form cube corner reflective elements 230*c* on a designated cell like interior surfaces 230 of said face 212. Marker 200 also have textured and grooved planar base surface 220 with integrally extended base portion 220*a* for added adhesion area.

The inclined planar reflective face 212 integrally has the interior cell like surfaces 230 defined by the hollow cavity means 300, which allow the integrally formed cube corner reflective elements 230*c*, to remain freely open within air gaps provided by said hollow cavity means 300.

Reflective cells 230 can be of any desired shape or size. Various body shapes, reflective cells and cube-corner reflective element designs can be formed utilizing the method of the present invention. The following U.S. Patents provide suitable exterior body shape, cell and or cube corner element designs, therefore, all of the following arts are incorporated as reference in their entireties: U.S. Pat. Nos. 4,726,706 and 5,927,897 to Attar.

The outside surfaces of interior cells 230 are integral part of planar reflective face 212. The interior cells 230 are positioned on designated cell like areas within inside surface of the reflective face 212, and defined by hollow cavity means 300, which provide the ejection means for injection molding of said multiple of protruding cube corner reflective elements 230*c*. The reflective elements 230*c* within an interior cell 230 are isolated from adjacent cells by integrally formed load carrying interior walls 310, which are tapered outwardly, thereby defining the hollow cavity means 300. Hollow cavity means 300 are directly beneath the interior of each cell 230. Each hollow cavity 300 is formed corresponding to the size and shape of the interior cell like surfaces 230 with the protruding cube corner reflective elements 230*c*. Hollow cavities 300 are integrally positioned with their centerlines 500 forming angle ($\phi$) of about 80 to 100 degrees with respect to the outside planar surface of reflective face 212, thereby allowing uninterrupted injection molding process, hence providing the means for integrally forming the cube corner reflective elements. The load carrying interior walls 310 are tapered forming an angle (A) equal or less than 5 degrees with respect to each centerline 500. Hollow cavities 300*a* are used when the desired marker is to have only one side with reflective face, as shown in marker 200. Hollow cavities 300*a* can provide the means to form cube corner reflective elements on the inside cell like surfaces of the top portion 214.

Both hollow cavities 300 and 300*a* will be tapered outwardly and open through the textured and grooved planar base surface 220 thereby forming air gaps beneath each individual interior cell 230. Hollow cavities 300 and 300*a* can have some of the load carrying interior walls 310 and the interior surface of top portion 214 formed with textures or arcuate grooves 310*a* for added reflectivity, surface opaqueness, enhancing daytime reflectivity and improving the structural strength of the marker.

Marker 200 is made in one-step injection molding process, either in one stage or two-stage injection from a high impact resistance polymeric material, either in one color or two-color injection molding process.

Thermoplastic such as high impact resistance acrylic, polycarbonate or any other high impact resistance polymers are suitable to be used in this process. Reflective face 212 can have either three raw, two raw or one raw of reflective cells 230, depending on the desired size, shape or height of marker 200 and the reflective cells 230 being used in this process.

For applications in sunny and hot environment, where bituminous hot-melt adhesive may be used, to agglutinate any marker to the roadway, the low melting point of such adhesive material may lead to adhesive failure known as cookie cutter effect, where a marker agglutinated to the pavement, may be forced by traffic impact load to move away from it's intended location on the roadway.

The science of material welding teach us that one of the primary variables to good adhesion of two surfaces is the total surface area to be wetted by the adhesive (welding) material, this area can be called the welding parameter, therefore, we can improve adhesion of marker 200 to a substrate, perhaps more effectively than the previous arts. This improvement in welding parameter can be achieved by using one of various arcuate shaped recesses within the base surface, each having discontinuous length. The grooves are perpendicular to traffic direction. Each groove can have length of about an inch or less and textured surface, preferably by sand blasting the corresponding part of the tooling.

The width or depth of such grooves should be less than 0.10 inch in-depth, by using short and discontinuous grooves, each near an inch in length with textured surface. In addition, planar base surface 220 can have an integrally extended portion 220*a*, which extends beyond the periphery of marker body for added adhesive grip.

Yet another mean to improve the adhesive welding parameter of the grooved planar base surface 220 is by capping the open ends of hollow cavities 300 and 300*a* by a corresponding shaped plate 185 with textured and grooved surface. Plate 185 can be used to plug a designated recessed area that can be provided within the base surface 220, such recessed area will include all the openings of the hollow cavities 300 and 300*a*, thereby allowing sonic welding of said plate 185 to said recessed area of the base 220.

In other applications where the desired marker to have two reflective faces with one or two colors, shorter body depth, lower height or maximum welding parameter at the marker base area. In this case, embodiments such as marker 10 and 10*a* can be formed in accordance to the method of the present invention. FIGS. 7 through 11 illustrate marker 10 comprises of two integrally formed near identical shaped marker 10*a*, welded or glued together. Marker 10 can have either transparent or partially pigmented body.

Each marker 10*a* integrally comprises an inclined planar reflective face 110, a top portion 121, two arcuate sides 125, a planar rectangular base surface 150 with textured discontinuous grooves, said base surface 150 can have an integrally extended base portion 130 which extends beyond the periphery of the top portion of marker body, and back portion 160 forming perpendicular angle with respect to the planar base surface 150, said back portion 160 includes beaded surface and hollow cavities 165. Various bead shapes or edges can be incorporated on the back portions 160, thereby fusing said back portions to each other during sonic welding.

The planar reflective face 110 integrally has interior cell like surfaces 115 with means to integrally form multiple of cube corner reflective elements 115*c* on said interior cell surfaces 115.

The interior cells 115 are open within air gaps provided by the hollow cavity means 155, such openings are through the base surface 150. The centerline of each hollow cavity 155 forms an angle ($\alpha$) of about 80 to 100 degrees with respect to the outside surface of reflective face 110. Each hollow cavity 155 separated from each other by an outwardly tapered partition and load carrying walls 155*a*.

It can be shown that marker 10 can have any commonly used shape or size and the reflective face can have either one raw or multiple raw of reflective cells, each cell having either hexagonal, rectangular, rhombic or circular shape or a marker with round base and spherical surface. When additional welding parameter (area) is needed for the base surface 150, the entire open ends of hollow cavities 155 can be capped by correspondingly shaped plate 180, as in FIG. 11, which can be welded onto a corresponding size and shaped recessed area that can be provided within the base surface 150. Marker 10 can be formed by means of welding the backsides 160 of two identical markers 10*a*. Two markers 10*a* are injection molded with thin wedge connection 166. Wedge 166 can be tore apart so that, two markers 10*a* with contrasted colors can be welded at the back side 160, forming marker 10.

An alternative forming means can form each part 10*a* having a transparent segment, only within the reflective face 110 region, and the remaining segment of part 10*a* to be opaque.

Marker 10 is manufactured by means of an injection molding process, integrally including the two parts 10*a*, and forms the two parts with one color or two color segments.

Various embodiments according to the process of this invention can have improved abrasion resistant body. Preferably by coating the marker reflective face or the entire outside surface with either silicon dioxide (SIO2) film, or with diamond-like carbon film, as per referenced U.S. Pat. No. 5,927,897 to Attar. The process of the present invention can also be utilized to make other roadway markers, such as barrier delineators as well as temporary markers and mini marker for insertion into metal-based markers, such as used in snowy regions.

Figure 15:
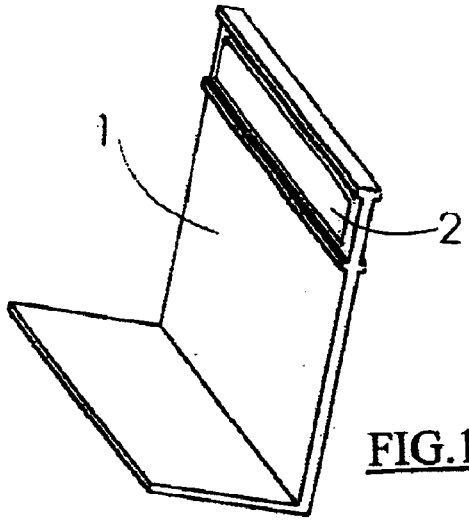
FIG. 15 (FIG. Prior Art 15) is an isometric view of conventional slurry seal delineator.

FIG. 15 (Prior Art 15) illustrates a schematic view of a typical L shaped delineator. This delineator made having either extruded or injection molded body 1, and two reflective strips 2 attachments, each with multiple cube corner reflective elements, said strips 2 adhered onto the top part of said body.

Figure 16:
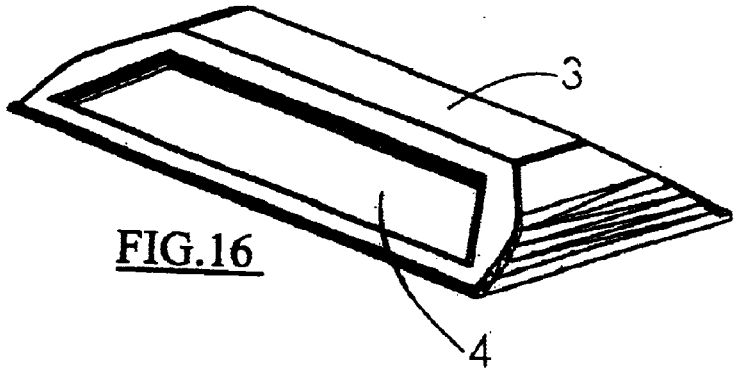
FIG. 16 (FIG. Prior Art 16) is schematic view of a temporary pavement marker.

FIG. 16 (Prior Art 16) illustrates another delineator or temporary marker. This type of temporary marker is usually made of two parts, a body with multiple of hollow cavities 3, and at least one reflective plate attachment 4.

The process of the present invention can integrally form the entire delineator or temporary roadway marker's structural body including the cube corner reflective elements by means of one single injection molding cycle. Such delineator or temporary roadway marker made of one type or two types of high impact and tear resistant thermoplastics. At least the reflective face portion integrally made of optically clear thermoplastic, including the cube corner reflective elements.

The illustrated embodiments in FIGS. 17 through 25 exemplify few delineators and temporary markers that can be manufactured according to the process of present invention.

Figure 17:
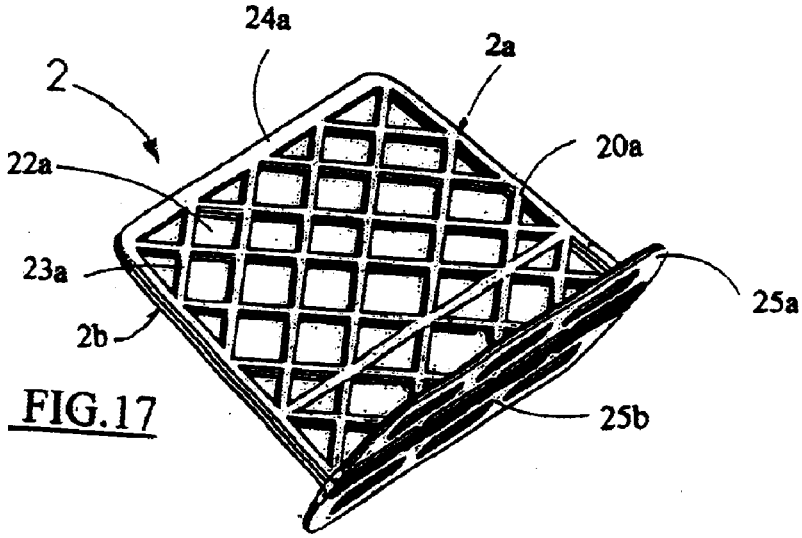
FIG. 17 is an isometric view of preferred delineator made in accordance to the invention.
Figure 17B:
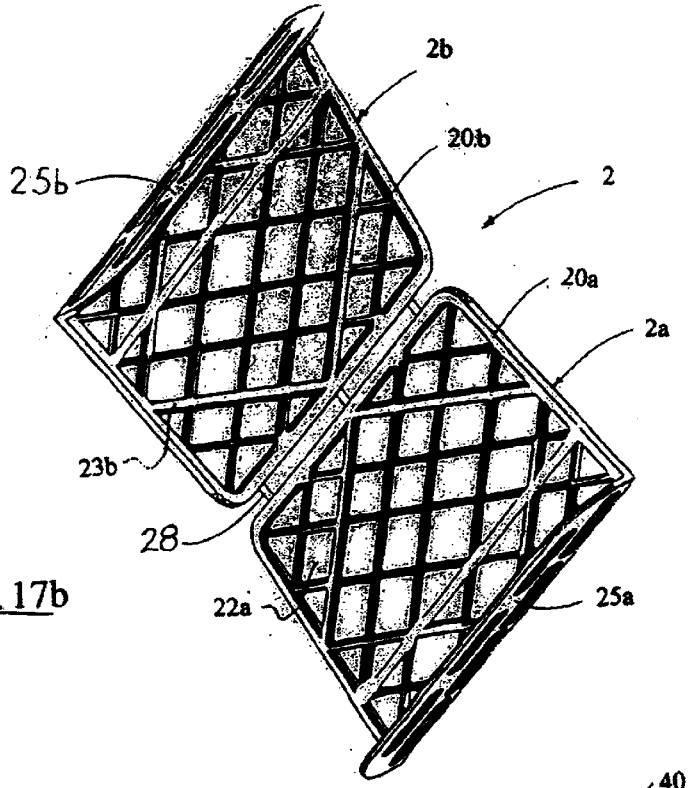
FIG. 17*b* is isometric view of delineator of FIG. 17 before sonically welding the two sides.

FIGS. 17 and 17*b* show one of the preferred embodiments of a delineator 10. Delineator 10 is manufactured using means in accordance to the present invention. FIG. 17*b* in particular shows the two sides 10*a* and 10*b* of delineator 10, within the proximity of their position while being ejected during the injection molding process of delineator 10. Each side 10*a* comprises a planar base portion 25*a* with grooves and a vertically positioned reflective face portion 20*a*. The base portion 25*a* is near perpendicular to face portion 20*a*.

Face portion 20*a* is having two distinct sides, an interior side and exterior side. Both sides of face portion 20*a* are integrally partitioned into multiple of cell like shapes 22*a*. Cells 22*a* having planar surfaces on the exterior side, said planar exterior surfaces separated from each other by raised load carrying partitions walls 23*a*. Cells 22*a* have interior surfaces with means for including and integrally forming multiple of cube corner reflective elements.

The interior surfaces of the cells 22*a* are isolated from each other by the interior extension of partition walls 23*a*, said interior extension of walls 23*a* having wedge shaped top segment, means for allowing said partition walls to be sonically welded to the corresponding walls of the delineator's opposing side 10*b*. Side 10*a* can be formed having periphery walls 24*a* defining the face portion 20*a*, and providing means to interlock with the corresponding walls 24*b* on the integrally formed opposite side 10*b*. Periphery walls 24*a* can also be integrally formed with textures or beads on its surface to partially fuse with said opposite walls 24*b* on side 10*b* of delineator 10. The fusion of periphery walls 24*a* and 24*b* as well as partition walls 23*a* and 23*b* can be achieved by means of sonically welding the two sides 10*a* and 10*b* of the delineator 10. Similarly, side 10*b* comprises top face portion 20*b*, and a planar base portion 25*b*. The face portion 20*b* having similar cell like shapes 22*b* corresponding to the opposing side 10*a* of delineator 10. Cells 22*b* are isolated from each other by the load carrying raised partition walls 23*b*. Each cell 22*b* having an interior surface with means to integrally include multiple of cube corner reflective elements. The interior portions of the partition walls 23*b* are integrally formed with means for having the top segment fuse to the corresponding wedge shaped top segments of walls 23*a* of side 10*a*. These top surfaces of partition walls 23*b* and the top of periphery walls 24*b* provide means for sonically welding of both sides 10*a* and 10*b* of the delineator 10.

Sides 10*a* and 10*b* are integrally injection molded with wedge shaped ties 28, said ties 28 can be folded or split apart, thereby allowing the two sides 10*a* and 10*b* to interlock and/or sonically welded to each others interior side. After the two sides 10*a* and 10*b* are interlocked or welded, air gaps will be retained between the inside surfaces of each two opposing cells 22*a* and 22*b*, thereby allowing maximum retro reflectivity on two opposing traffic paths, via the cube corner reflective elements within the interior surfaces of said cells 22*a* and 22*b* of sides 10*a* and 10*b*.

Various types of interlocking devices, welding methods, and types of cube corner reflective elements and method of forming the same are available and can be incorporated in the process of forming delineators or temporary roadway markers or low profile markers, in accordance to the present invention.

Descriptions of suitable cube corner reflective elements are provided in U.S. Pat. No. 3,712,706 to Stamm; U.S. Pat. No. 3,922,065 to Schultz; and U.S. Pat. No. 4,588,258 to hoopman, all of which are incorporated herein by reference in their entireties.

Any desired height, geometric shapes or the overall thickness of the welded sides of the reflective face portion cab be incorporated in the process of the present invention.

Figure 18:
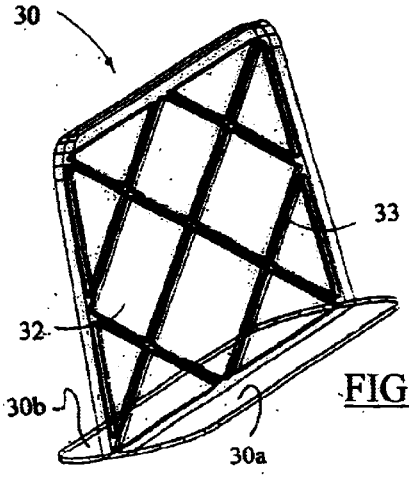
FIG. 18 is an isometric view of barrier-delineator manufactured accordance to the invention.

FIG. 18 illustrate an isometric view of another preferred delineator 30, said delineator 30 can be injection molded in one piece with two sides 30*a* and 30*b*, in accordance to the process of the present invention. Delineator 30 has fewer partition walls 33 on each side, thereby allowing the formation of larger reflective cells 32 on both sides 30*a* and 30*b*, of said delineator 30. Each side 30*a* and 30*b* has a planar and grooved base surface 35.

Figure 19:
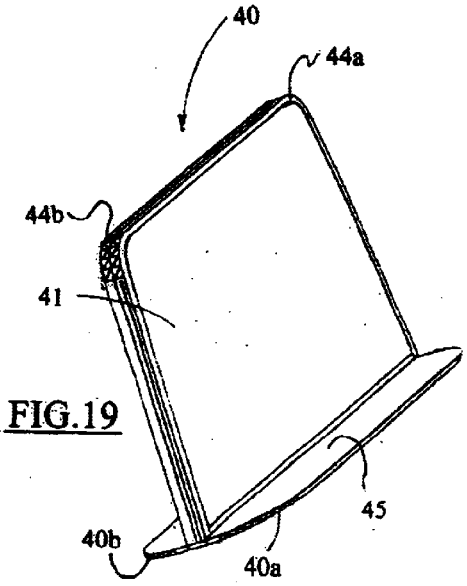
FIG. 19 is isometric view of another barrier-delineator based on the present invention.
Figure 22:
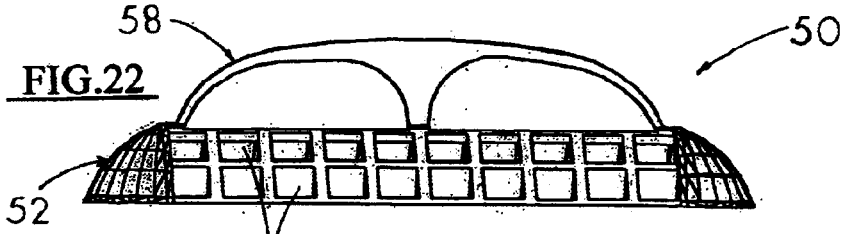
FIG. 22 is an elevation view of the delineator of FIG. 20 showing both top and lower body.

FIG. 19 shows an isometric view of yet another delineator 40, preferably for use on the top or sides of concrete barriers, such barriers are commonly used to separate two directional traffics. The two sides 40*a* and 40*b* of delineator 40 have no interior partition walls. Each side has a reflective portion 41, integrally including means to form cube corner reflective elements on the interior surface, and grooved planar base surface 45. By sonically welding the two integrally connected sides 40*a* and 40*b* at the beaded interior surfaces of the periphery walls 44, thereby delineator 40 is formed.

Figure 20:
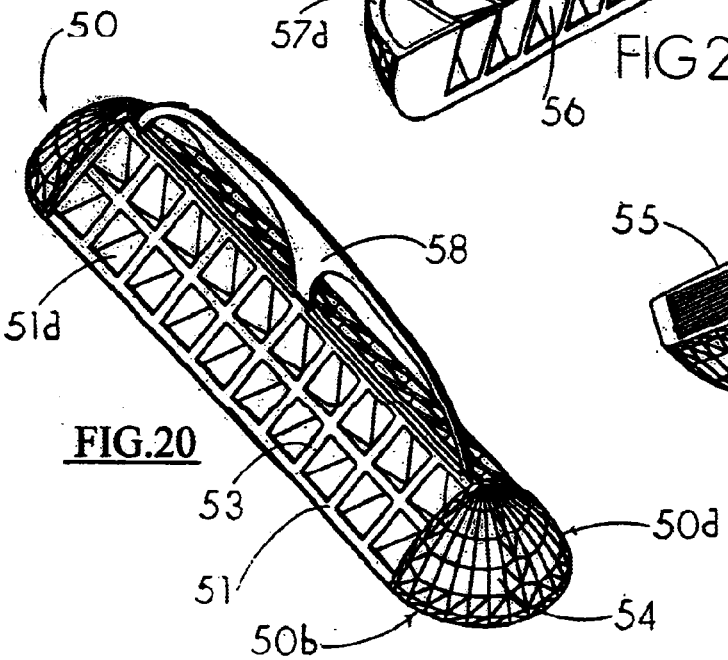
FIG. 20 is isometric view of a dual use delineator-temporary marker as per this invention.
Figure 21:
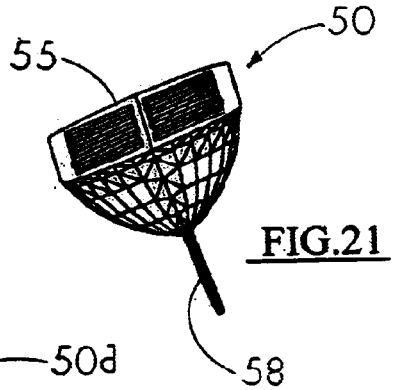
FIG. 21 is another isometric view of marker in FIG. 20 showing the base surface.

FIGS. 20 through 25 illustrate yet another novel structure that can be manufactured using the means in accordance to process of the present invention. In FIG. 20, there is shown a preferred embodiment of a temporary roadway marker 50 integrally formed in accordance to the present invention. Temporary marker 50 comprises of means to integrally forming the two sides 50*a* and 50*b* near identical to each other. Each side is having an upper segment 58 that resemble a handle bar, which will be called handle bar 58 from hereupon, and a lower body 52. Body 52 is having two arcuate sides 54, an inclined planar face 51 with multiple of reflective cell like areas 51*a*.

The two rows of cells 51*a* having planar exterior surfaces, and interior surfaces with means to integrally include multiple cube corner reflective elements, said interior surfaces of cells 51*a*, open within hollow cavity means 56 and 56*b*. Body 52 also includes load carrying partition walls 53 and a backside 57, said backside 57 with beading means for sonically welding the opposing backsides of delineator sides 50*a* and 50*b*, thereby forming temporary marker 50. The two sides 50*a* and 50*b* are formed interconnected by means of thin ties that are provided at the upper periphery of handle bar 58.

FIG. 25 shows an isometric view of one side 50*b* of temporary marker 50, illustrating the planar base surface 55, integrally including one row of multiple of hollow cavities 56. Hollow cavities 56 are open directly beneath the lower row of cells 51*a*, thereby providing the means to form cube corner reflective elements on the interior of said lower row of cells 51*a*. Also shown in FIG. 25, the backside 57, which consist of two segments 57*a* and 58*b*. Segment 57*a* is the backside of lower body 52, and the upper segment 58*b* is the backside of the handle bar 58 of side 50*b* of temporary marker 50.

Segment 57*a* having textured planar surface that can be provided with beads to be welded to the opposite side of marker 50, also shown multiple of hollow cavities 56*b*, which are open through said segment 57*a*. Hollow cavities 56*b* are open directly beneath the upper row of reflective cells 51*a*, thereby providing the means to integrally form multiple of cube corner reflective elements on said inside surfaces of upper row of cells 51*a*.

The upper segment 58*b* is the interior surface of handle bar 58. Segment 58*b* is also formed with means to integrally includes multiple of cube corner reflective elements, within periphery edges 59, said periphery edges 59 provide means to sonically weld the two handle bars 58, of marker 50.

Hollow cavities 56 and 56*b* provide the means to have air gaps directly beneath the inside surfaces of each cell like areas 51*a*. Cells 51*a* are separated from each others by the load carrying walls 56*c*, that form hollow cavities 56 and 56*b*.

The out side planar surfaces of the cells 51*a* can be either continuous part of the inclined planar face 51, or slightly recessed bellow the outside surfaces 56*d* of the load carrying walls 56*c*.

Figure 23:
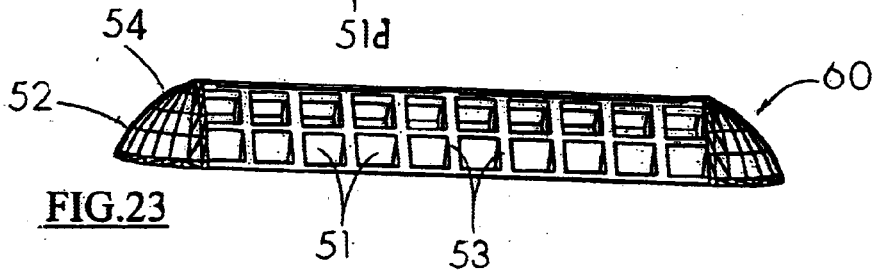
FIG. 23 is an elevation view of delineator of FIG. 20 without the top portion.
Figure 24:
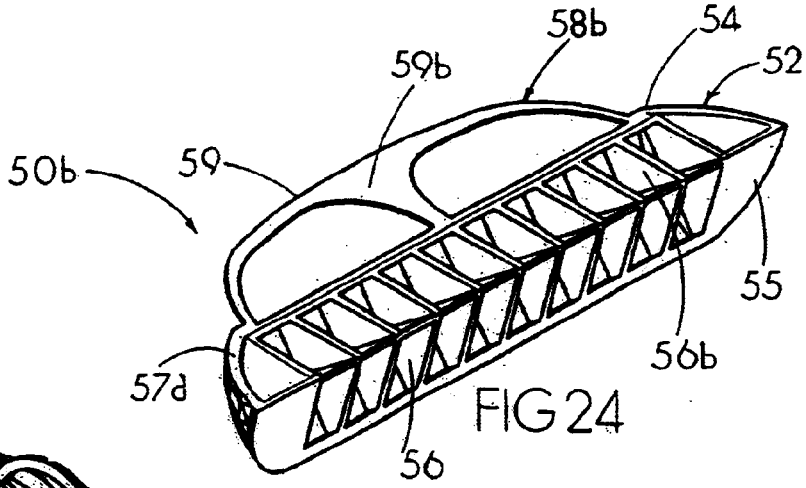
FIG. 24 is an isometric view of one side of delineator of FIG. 20, showing the backside.

When the two sides 50*a* and 50*b* are sonically welded fusing the textured or beaded backsides, an air gaps will be retained, both in the upper handle bar 58 and the lower body 52, thereby providing retro reflectivity, both from the handle bar segment and from the lower body segment, and on two opposing traffic paths. The handle bar segments 58 can be integrally formed from highly transparent and resilient plastic. Temporary marker 50 can also be formed having means for allowing the handle bar to be tore off the lower body, thereby leaving a low profiled reflective marker on the road after the first phase of construction is finished, as shown in FIG. 23 with a designated temporary marker number 60.

Various combinations of size, height or geometric shape for markers 10,30,40 or 50 can be incorporated in the forming process of the present invention.

Preferably marker 50 can have the height of the lower body 52 about 0.40 to 0.60 inch, with a base having width of about 3.0 to 5.0 inches and depth of about 1.0 to 3.0 inches. The upper handle bar 58 can have various shapes and a height of about 1.00 to 1.50 inches, with overall thickness of about 0.05 to 0.10 inch. Pressure sensitive adhesives can be added to the base of all delineators or roadway markers for quick installation of said roadway markings.

In some construction applications where the need for delineator is only for few days and for one-way traffic, one side of delineator 10 or marker 50 can be formed to be effective in such applications.

The present invention includes within its scope a method for making the monolithically formed reflective pavement marker or delineator, comprising the steps:

selecting the pavement marker shape, polymers to be used, types of cube corner reflective elements to be used, body shape, sizes of reflective cells used and the injection molding method to be utilized for said method of making, providing a tooling means which allow the injection molding of said reflective pavement marker or delineator, integrally including the cube corner reflective elements in one step, said tooling can be made to mold said marker having one color or two colors, providing hollow cavity means which allow integrally forming the cube corner reflective elements within said pavement marker during said injection molding process, providing the angular position of said hollow cavity means with respect to the inclined reflective face of said pavement marker to allow uninterrupted ejection cycle during said injection molding of said reflective pavement marker or delineator.

It is understood that various changes or modifications can be made within the scope of the appended claims to the above-preferred method of forming one-piece reflective marker without departing from the scope and the spirit of the invention. The principle processes of this invention are not limited to the particular embodiments described herein. Various embodiments can employ the processes of this invention. This invention is not limited to the exact method illustrated and described; alternative methods can be used to form the intended monolithically formed reflective pavement marker of this invention. Therefore, the invention can be practiced otherwise than as specifically described herein.

What is claimed:

1. A method of monolithically forming one piece reflective pavement or delineator marker including multiple of cube corner reflective elements comprising the steps of:

a) providing tooling means which allow injection molding of said reflective pavement marker integrally including the cube corner reflective elements, said tooling means can mold said pavement marker in one stage or two stage injection molding cycle, b) providing hollow cavity means which define the interior load carrying partition walls and allow integrally forming the cube corner reflective elements within said pavement marker during said injection molding process, c) providing the angular positions of said hollow cavity means with respect to the inclined reflective face of said pavement marker allowing uninterrupted ejection cycle during said injection molding of said reflective pavement marker, whereby said reflective pavement marker will be monolithically formed including said cube corner reflective elements and the load carrying partition walls.

* * * * *